US005411035A

United States Patent [19]

Stone

[11] Patent Number: 5,411,035

[45] Date of Patent: May 2, 1995

[54] ORTHOPEDIC WHEELED LEG SUPPORT

[76] Inventor: Heather E. Stone, 567 Scenic Dr., Cheney, Wash. 99004

[21] Appl. No.: 162,427

[22] Filed: Dec. 2, 1993

Related U.S. Application Data

[63] Continuation-in-part of Ser. No. 6,931, Jan. 21, 1993, abandoned.

[51] Int. Cl.[6] ..... A61H 3/04

[52] U.S. Cl. ..... 128/845; 188/5; 280/87.021

[58] Field of Search ..... 280/87.021, 87.05, 47.34, 280/657, 87.051; 188/5; 128/845

[56] References Cited

U.S. PATENT DOCUMENTS

| | | | |
|---|---|---|---|
| 1,668,623 | 5/1928 | Avril | 286/87.021 |
| 2,484,494 | 10/1949 | Ferguson | 280/87.021 |
| 2,536,503 | 1/1951 | Jones | 155/94 |
| 2,543,924 | 3/1951 | Mondy | 155/93 |
| 2,625,989 | 1/1953 | Pond et al. | 188/5 |
| 3,109,667 | 11/1963 | Wolner | 280/87.02 |
| 3,288,250 | 11/1966 | Oja et al. | 188/5 |
| 3,917,203 | 11/1975 | Heubeck et al. | 188/5 |
| 4,029,329 | 6/1977 | Chambers | 280/87.021 |
| 4,076,201 | 2/1978 | Hudnall | 248/102 |
| 4,085,763 | 4/1978 | Thomas | 135/69 |
| 4,254,948 | 3/1981 | Jacobs | 272/70.3 |
| 4,415,135 | 11/1983 | French | 248/161 |
| 4,662,680 | 5/1987 | Dauphin | 297/300 |
| 4,725,027 | 2/1988 | Bekanich | 248/125 |
| 4,832,407 | 5/1989 | Serber | 297/437 |
| 4,867,188 | 9/1989 | Reid | 135/67 |
| 4,909,264 | 3/1990 | Wadsworth, III et al. | 128/845 |
| 4,930,796 | 6/1990 | Harrod | 280/87.021 |
| 5,158,313 | 10/1992 | Becker | 280/87.021 |

OTHER PUBLICATIONS

Roberts et al., The Orthopaedic Scooter, 1990 British Editorial Society of Bone & Joint Surgery, pp. 620–621.

*Primary Examiner*—Robert A. Hafer
*Assistant Examiner*—Michael O'Neill
*Attorney, Agent, or Firm*—Keith S. Bergman

[57] ABSTRACT

A mobile orthopedic device to support a disabled leg of a standing patient while the leg is bent at the knee, especially as when partially amputated or encased in a cast or support device. A base having peripheral caster wheels supports a medial upstanding support shaft that is adjustable for height. The upper portion of the support shaft carries a horizontal support with padded upper surface configured to cradle the knee and adjacent lower leg of a patient. A handlebar assembly extends upwardly from the forward end of the horizontal support to aid user support, steerage and maneuvering of the device. A medial, adjustably depending foot optionally aids positional maintenance of the support on a supporting surface. A first species provides a releasable, adjustably positionable strap and knee pad that are carried on the upper surface of the horizontal support to aid positional maintenance of a supported leg to prevent overturning of the support in a forward direction. A second species provides a fixedly mounted caster wheel to aid steerage in a forward direction.

4 Claims, 4 Drawing Sheets

FIG. 14
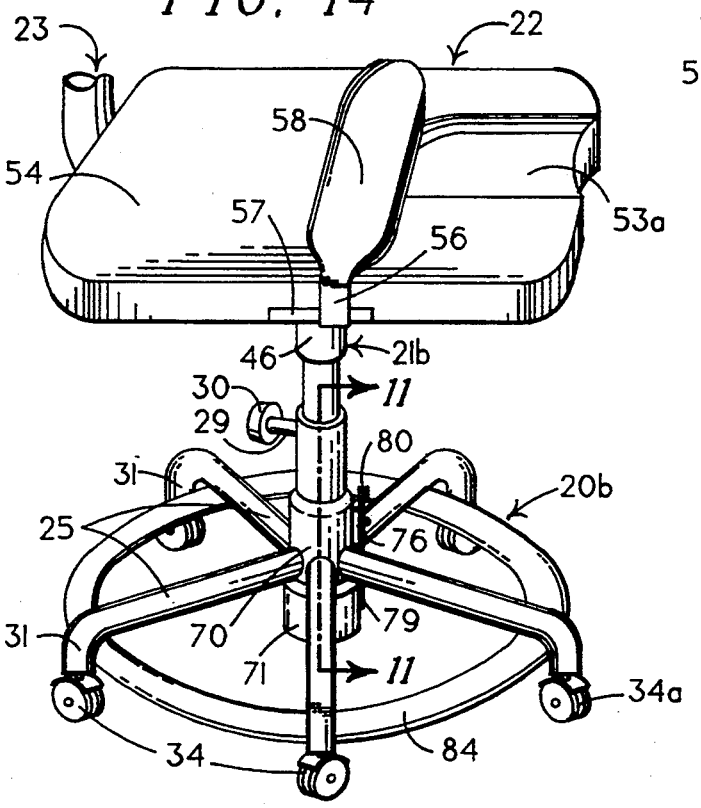
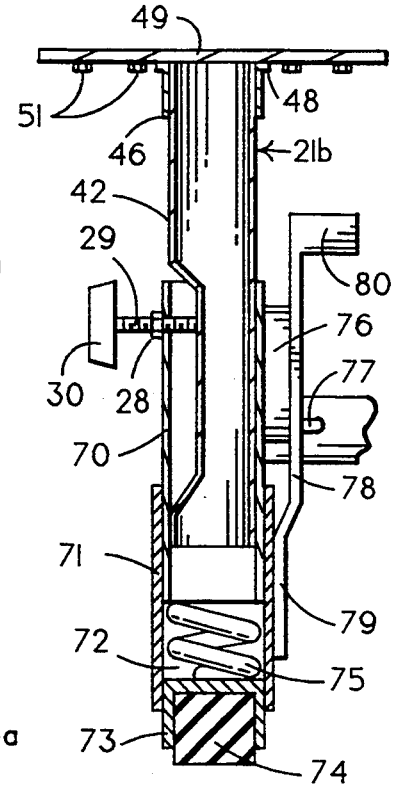
FIG. 11
FIG. 10
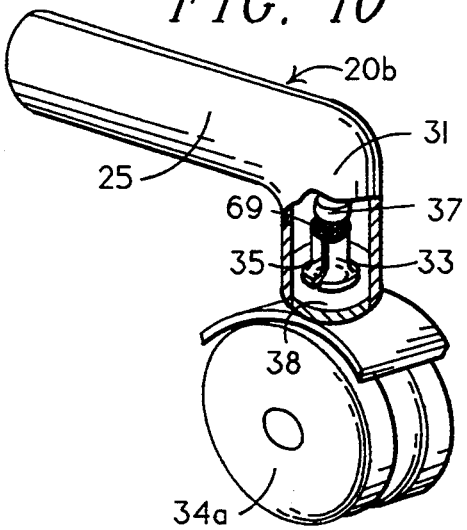
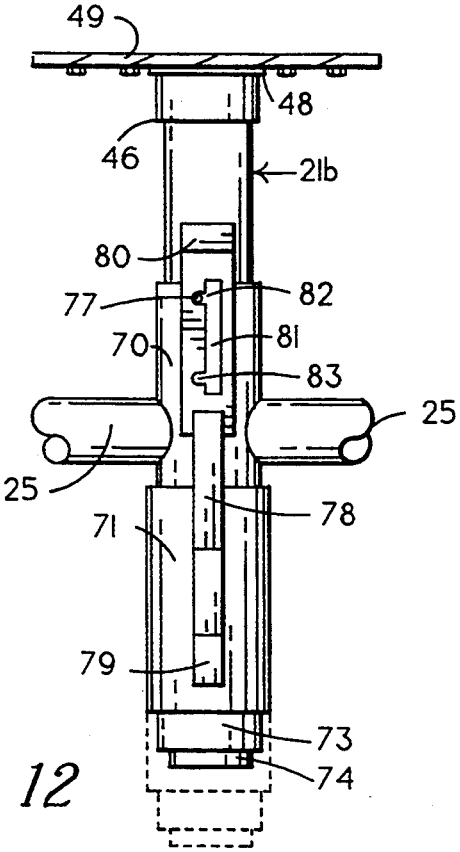
FIG. 12

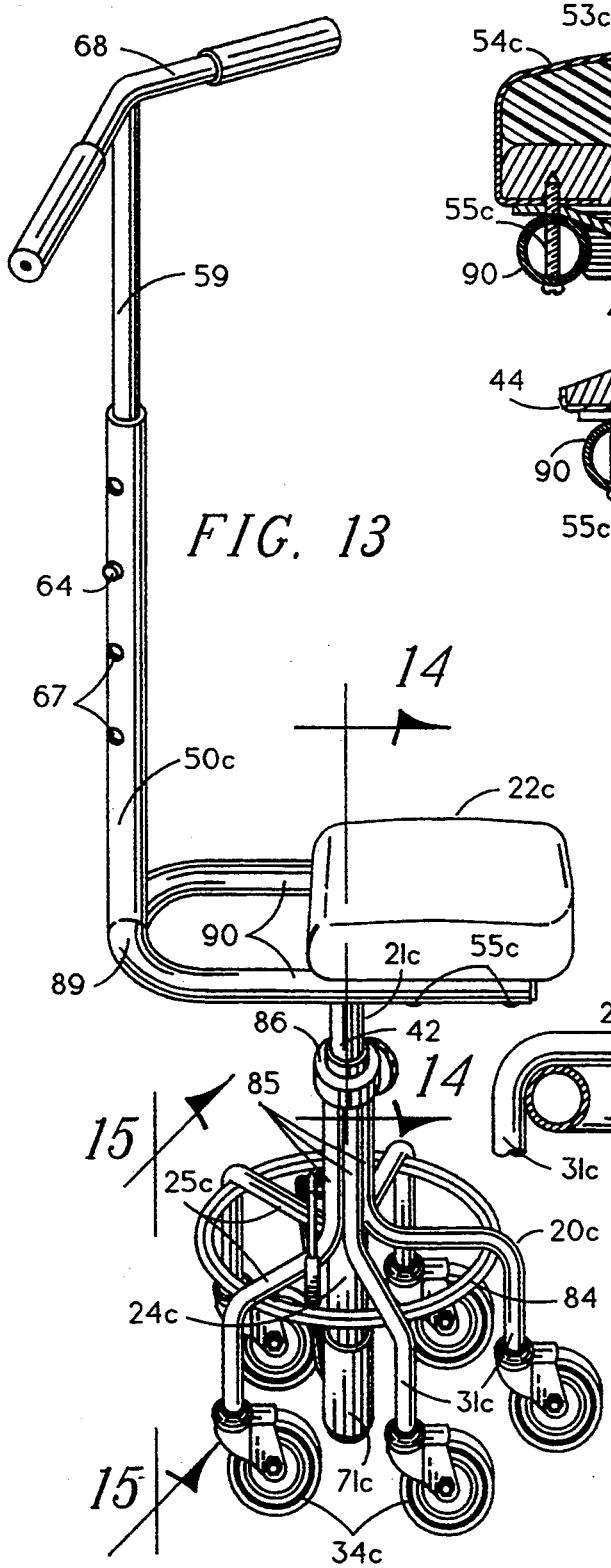
FIG. 13
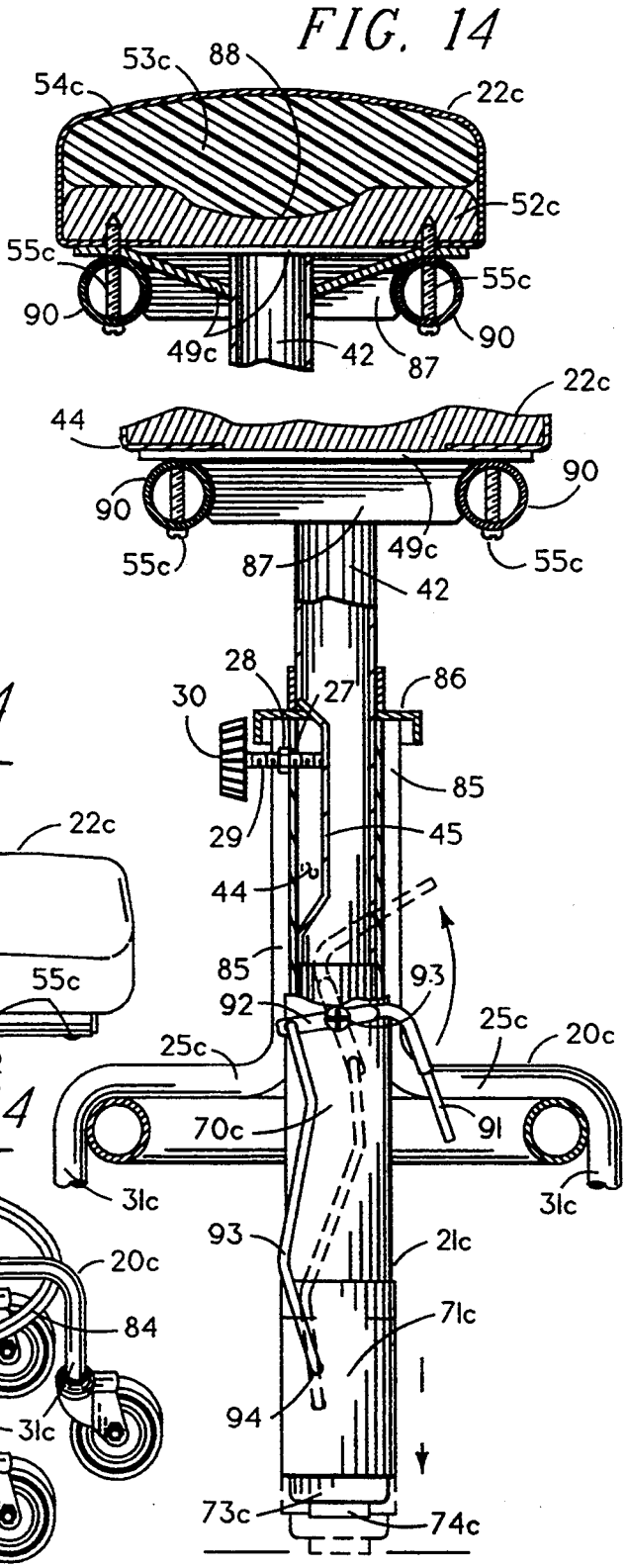
FIG. 14
FIG. 15

ORTHOPEDIC WHEELED LEG SUPPORT

RELATED APPLICATIONS

This is a continuation in part of an application filed Jan. 21 1993 under Ser. No. 08/006,931, that is now abandoned.

BACKGROUND OF INVENTION

1. Field of Invention

This invention relates to orthopedic supports, and particularly to a wheeled mobile support for the knee portion of a bent disabled leg of a standing patient.

2. Background and Description of Prior Art

Various known support devices to aid mobility of a patient with a disabled lower leg have generally taken the form of a wheel chair, optionally with an ancillary adjustable leg support, or crutches. Though both such supports are useful to fulfill their particular purposes, either poses inherent problems for a patient with only one disabled leg. The instant support seeks to solve such problems.

Wheel chairs are widely used for the transport of disabled patients of all types, but generally require a patient to be seated for locomotion, whether the chair is moved by the patient himself, by an associated motor or by a third party. This restricts a patient's ability to perform other tasks, such as work activities or ordinary household chores, while the patient is yet able to perform such functions were it not for the method and nature of his support.

Most wheel chairs also are relatively large, massive structures which are difficult to propel and maneuver and often by reason of such nature, cannot access areas that are restricted in space or crowded with objects or people. Many wheel chairs provide ancillary devices that support a leg or a portion of it in an elevated attitude to aid user comfort and sometimes avoid pain that would result were the leg not elevated. These ancillary devices only exacerbate access problems, while at the same time further limiting potential activities of a patient by reason of the postural attitudes required for their use.

My invention aids the resolution of these problems inherent in wheel chairs by providing a mobile device that supports only one disabled leg, while allowing a user to stand on the other leg, use that non-disabled leg to aid in moving the support, and use arms and upper body for other tasks. By reason of this structure, my support device may also be of substantially smaller size than a wheel chair and of a more mobile and maneuverable nature to allow a user to access areas that could not be accessed by a traditional wheel chair.

Crutches in various forms also have been widely used to aid support and locomotion of disabled patients especially when disability involves only one leg. Though mobility and access with crutches are less restricted than with wheel chairs, crutches also present inherent problems. They must be supported in some fashion by a user for locomotion, generally with the hands and commonly for effective support they must be used in pairs to require the use of both hands of a user. This requirement either substantially limits or prevents most other patient activities that require the use of the hands to prevent effective work activity by persons using crutches.

Normally crutches are partially supported by other parts of a user's body than his hands, commonly under the armpits or about the forearms, and this type of support and the posturing resulting by reason of it, not only restrict other activities but also often tend to create pain or irritation in a user's body by reason of crutch use. More importantly, however, the crutches provide no support for an injured lower leg to maintain it in an elevated position and this often may cause pain in an injured leg and give rise to other adverse physiological reactions such as excessive swelling, lack of circulation and the like.

My support in contradistinction provides a structure that supports a bent lower leg about the knee while maintaining the leg therebelow in an elevated position. My support also allows operation without use of either hand if desired, while yet not inhibiting normal use and motion of a non-injured leg or other non-disabled body parts.

Various surgical support devices in the nature of wheeled standards on occasion have been used as supports for disabled lower limbs. These devices, however, have not been widely used as they generally are cumbersome, ineffective and possess many of the disabilities of both a wheel chair and crutches. To use such devices for locomotion generally requires either control and support by the hands of a user or mechanical interconnection to some other type of locomotion device and in either case, they are as cumbersome, ineffective and restrictive as traditional-supports. In general, standard type supports also will not support an injured limb in an elevated position. These features distinguish my invention from the standard type support.

My support provides a plurality of caster wheels arrayed about the periphery of a circular base structure for support and locomotion. To further aid directional motion and steerage of my support, one caster wheel structure is not rotatable perpendicularly to the wheel journalling axle to allow that wheel to direct the support in a particular course. Another species provides an adjustably depending pedestal to aid positional maintenance of my support on a supporting surface when desired. These features further distinguish my support from a wheel chair which provides two wheel steerage by support wheels and crutches which provide no wheeled support or steerage at all.

My invention lies not in any one of these features individually, but rather in the synergistic combination of all of the structures of my invention that give rise to the functions necessarily flowing therefrom, as herein specified and claimed.

SUMMARY OF INVENTION

A mobile orthopedic device to support a disabled lower leg provides a base, having plural caster wheels in spaced array about its periphery, supports a vertical upstanding support shaft which is selectively adjustable in height. The support shaft carries a horizontal leg support having a padded upper surface configured to cradle the knee portion of a user's bent lower leg. A vertically adjustable handlebar assembly extends upwardly from the horizontal support for manual manipulation to aid user support and maneuvering of the device. The support optionally provides an adjustable depending pedestal to aid in positionally maintaining the device on a supporting surface. A first species provides a larger leg support with a strap having a medial pad is releasably carried by the upper surface of the horizontal support to maintain a supported leg in a rearward position to prevent forward overturning of the device. A second species provides an areally smaller leg support positioned on the rearward side of the center of gravity of the support to prevent forward tipping of the support.

In providing such device, it is:

A principal object to create a wheeled orthopedic support that supports a bent lower leg of a user at the knee while allowing the user to stand on the other leg and move the support about.

Another object is to provide such a support that allows a user to stand with a disabled leg supported while allowing free use of hands, arms and upper body.

Another object is to provide such a support that maintains a disabled lower leg of a user in an elevated position to increase comfort of support and reduce potential deleterious physiological reactions.

A further object is to provide such a support that is easily moved and controlled by a patient by means of the supported leg, hands, or both as desired.

A further object is to provide such a support that is of a smaller, more compact and more maneuverable configuration than a wheel chair, and in its primary form has the potentiality to turn in any direction without the necessity of forward movement.

A still further object is to provide such a support that is supported by plural caster wheels with one wheel structure irrotatable about a vertical axis to direct support motion in a predetermined direction relative to the horizontal support.

A still further object is to provide such a support that has an adjustable depending pedestal to selectively maintain a position on a supporting surface.

A still further object is to provide such a support device that is of a new and novel design, of rugged and durable nature, of simple and economic manufacture and otherwise well adapted to the uses and purposes for which it is intended.

Other and further objects will appear from the following specification and accompanying drawings which form a part hereof. In carrying out the objects of my invention, however, it is to be remembered that its accidental features are susceptible of change, in design and structural arrangement, with only one preferred and practical embodiment of the best known modes being illustrated and specified as required.

BRIEF DESCRIPTION OF DRAWINGS

In the accompanying drawings which form a part hereof and in which similar numbers of reference refer to similar parts throughout:

FIG. 9 is an isometric surface view of a support having a fixedly mounted caster wheel and a depending pedestal for positional maintenance on a supporting surface.

FIG. 10 is an enlarged, partially cut-away isometric view of the fixed interconnection of one caster wheel in the leg supporting it.

FIG. 11 is a medial vertical cross-sectional view of part of the support shaft of FIG. 9, taken on the line 11—11 thereon in the direction indicated by the arrows.

FIG. 12 is an orthographic surface view of the mechanism that vertically positions the depending foot of the device of FIG. 9, taken from the right side of that Figure.

FIG. 13 is an isometric side view of a second species of my device having a smaller horizontal support.

FIG. 14 is a transverse vertical cross-sectional view through the horizontal support of the device of FIG. 13, taken on the line 14—14 thereon in the direction indicated by the arrows.

FIG. 15 is a vertical cross-sectional view with portions cut away to show details of the device of FIG. 13, taken on the line 15—15 in the direction indicated by the arrows thereon.

DESCRIPTION OF THE PREFERRED EMBODIMENT

My orthopedic support device generally comprises wheeled base 20 carrying medial upstanding support shaft 21, that in its upper part supports horizontal support 22, which in turn supports handlebar assembly 23 extending thereabove.

Figure 1:
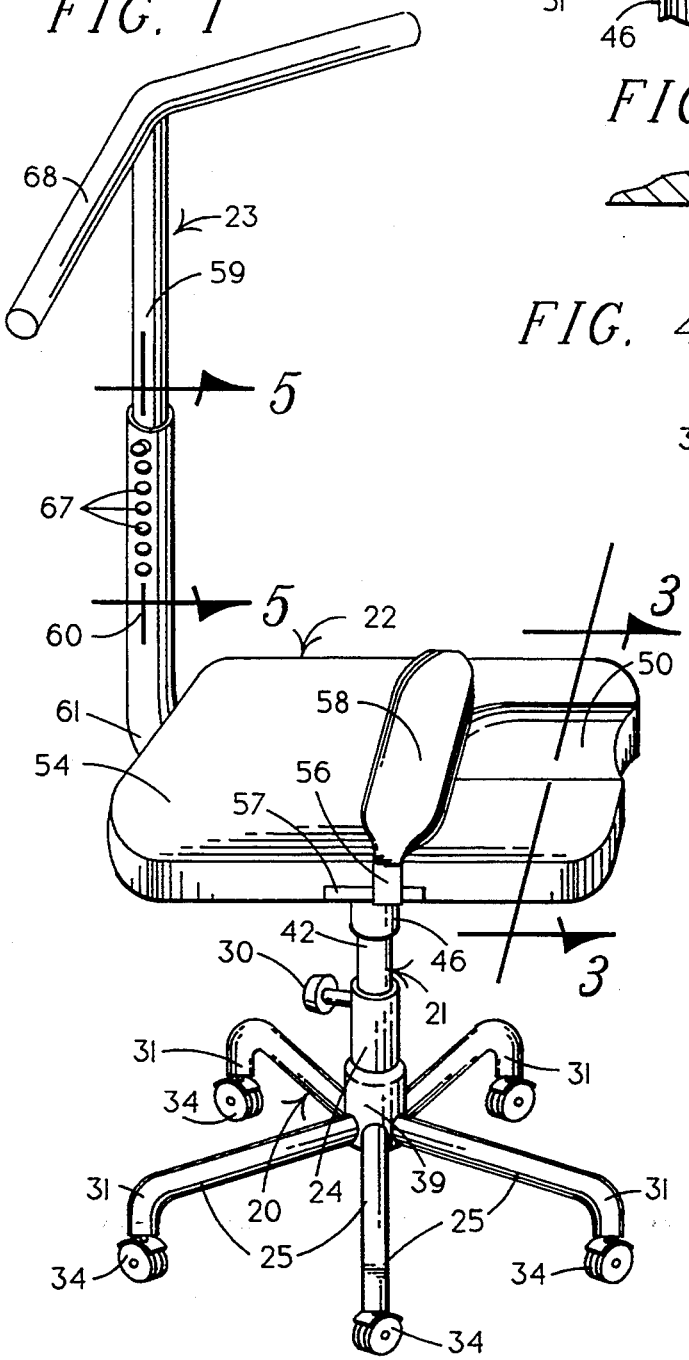
FIG. 1 is an isometric view of the first species of my support, showing various of its parts, their configuration and relationship.
Figure 4:
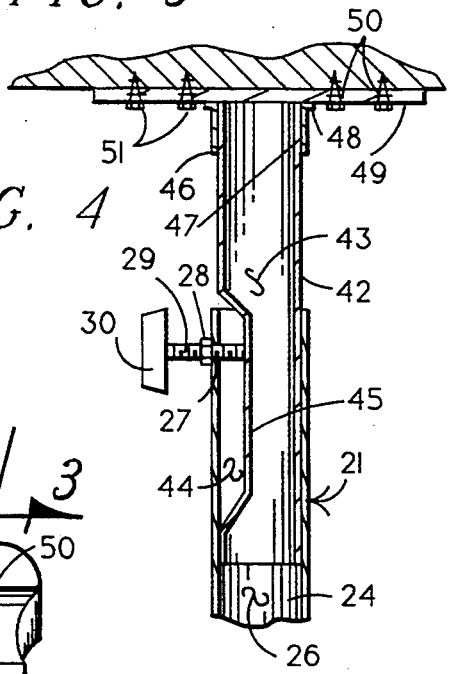
FIG. 4 is a partial vertical cross-sectional view through the vertical support of FIG. 2, taken on the line 4—4 thereon in the direction indicated by the arrows.
Figure 2:
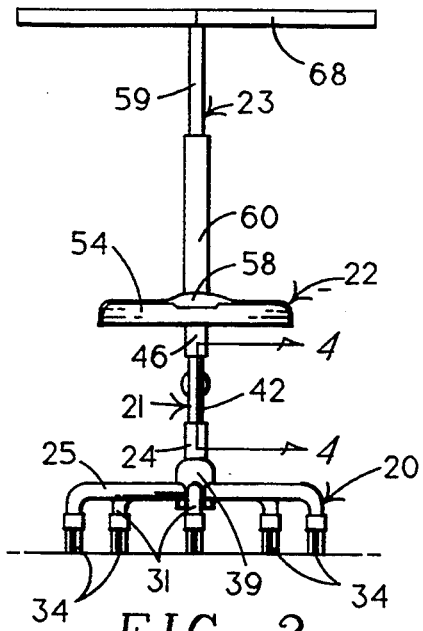
FIG. 2 is a somewhat reduced, orthographic rear view of my support, taken from the right side of FIG. 1.

Wheeled base 20, as seen in FIGS. 1 and 2, provides central tubular hub 24 structurally supporting a plurality of wheel legs 25 extending radially in a horizontal orientation therefrom. Hub 24 defines medial cylindrical channel 26 to receive a support shaft in slidable interconnection and has sufficient vertical extension to provide such an interconnection of reasonable strength. As seen especially in FIG. 4, the upper side portion of the hub defines hole 27 structurally carrying nut 28 thereabout to threadedly receive adjustment screw 29 having enlarged head 30 to aid manual manipulation in fastening a support shaft in the hub channel 26.

Wheel legs 25 provide outer down-turned portions 31 to aid interconnection of caster wheels and to provide some additional height for the central hub 24 above a supporting surface.

Wheel legs 25 comprise peripherally defined tubular beams having an arcuate cross-sectional periphery for safety and appearance. The wheel legs 25 are arrayed about the central hub 24 to extend radially with circular symmetry and may have somewhat of a downward and outward angulation to add strength to the structure. The legs may be connected to the outer surface of the hub 24 or, if desired, may pass through holes defined in that hub (not shown) to meet in the central portion of channel 26 where the inner ends of all wheel legs may be interconnected to provide additional strength. Both configurations are known in similar devices and are within the scope of my invention.

Figure 7:
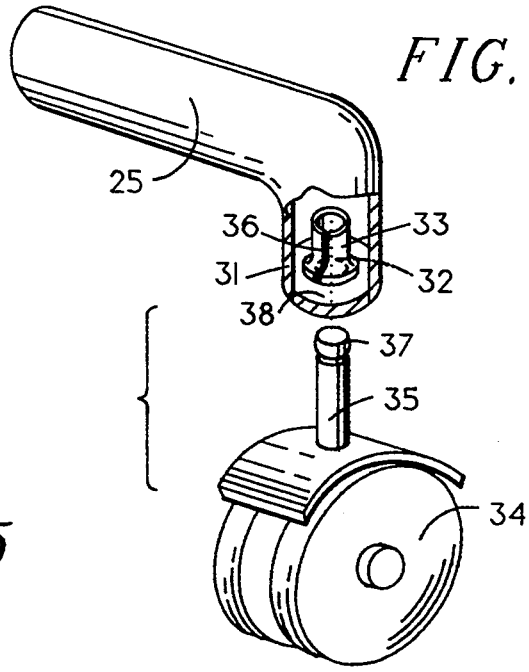
FIG. 7 is an enlarged, partially cut-away and expanded isometric view of the outer portion of a support leg and the associated caster wheel.

As seen in FIG. 7, downturned portions 31 of each wheel leg carry structurally joined end caps 38 which define holes 32, preferably with bushings 33 supported by the end cap to extend a spaced distance inwardly therefrom to provide additional support for a caster wheel shaft. End cap 38 carries upstanding support shaft 35, configured for rotatable carriage in hole 32 and associated bushing 33, which in turn supports caster wheel 34. Normally bushings 33 are somewhat tapered inwardly in an upward direction and define at least one axially parallel slot 36 that allows some deformation of the bushing so that the upper portion 37 of caster wheel shaft 35 may be slightly enlarged and yet pass through the bushing and thereabove to releasably maintain the caster wheel in the bushing against gravity displacement but yet allow removal if necessary.

This type of caster wheel assembly is not new or novel per se and is commonly used in various wheel supported devices. The number of wheel arms is not critical, but five rather than a lesser number are preferred to provide a higher degree of stability to meet the rigid safety requirements of orthopedic devices. The caster wheel illustrated is of a two-wheel type, but various other known caster wheel constructions, especially with partial spherical wheels or single wheels, are equally operable and included within the scope of my invention.

Normally both hub 24 and legs 25 are formed of tubular metal material to provide required structural strength and rigidity and if so, they are interconnected at their junctures by welding. Preferably, the junctures of the legs with the hub are protected by tubular cover 39 defining a medial channel incrementally larger than the hub, a truncated upper portion 40 to fit about the hub and lower openings 41 to fit about the inner portions of the legs. Though such a cover is aesthetically desirable, it is not necessary for the functioning of my invention. The amount of radial extension of legs 25 is not critical, but should be no greater than necessary to provide adequate stability under the conditions which my support may encounter. This normally requires a preferred radial extension of at least seven to eight inches.

Support shaft 21 comprises tube 42 defining medial channel 43. The tube 42 is similar in shape to and incrementally smaller than channel 26 of central hub 24 so that it may be received in a slidable but yet supported fit within the channel 26. As illustrated particularly in FIG. 4, the medial portion of tube 42 defines vertically orientated, radially inwardly extending fastening channel 44, of a width slightly greater than the diameter of adjustment screw 29, to receive that screw and allow it to exert fastening force on channel inner wall 45 to allow adjustable positioning of the support shaft within the central hub. The axial length of channel 44 is not essential, but preferably is several inches to allow vertical adjustment of a horizontal support to accommodate a substantial proportion of variably sized potential users of my support.

The upper surface of tube 42 structurally carries annular collar 46 which defines medial channel 47 to receive and support tube 42 and outwardly extending flange 48 to aid fastening to fastening plate 49. The fastening plate 49 is a flat rigid element of some areal extent defining a plurality of holes 50 to receive fasteners for engagement with a horizontal support thereabove.

Horizontal support 22 provides rigid base 52 supporting resiliently deformable padding element 53 on its upper surface. The base is of generally rectilinear shape, with upper configuration defining indented portion **52*a*** to aid in configuring the padding element to define a surface to support the knee portion of a human leg when cradled therein. This generally requires a horizontal support of length of approximately sixteen inches and width of approximately eight inches. The corners and edges of the rigid base and padding element are rounded to aid comfort of the support function.

Base 52 must have sufficient rigidity to support the lower leg of a user and the additional weight of the portion of the user's body that is supported thereby. I have found one inch thick plywood or plastic of comparable strength to be appropriate for this purpose. The base is attached to fastening plate 49 in a symmetrical position by plural fasteners 51, in the case illustrated comprising headed screws extending through holes 50 defined in the fastening plate and into threaded engagement with the base.

Padding element 53 is of the same bottom peripheral configuration as rigid base 52 and is structurally supported thereon by mechanical fastening such as adhesion. The padding element has an upper surface defining medial elongate channel **53*a*** to receive and aid in positionally maintaining the knee portion of a leg on the horizontal support. The padding element is formed of material of a resiliently deformable nature and sufficient thickness to support the weight placed upon it by a user's leg while yet retaining some additional resilient deformability, so as to provide maximum comfort and support. Various of the foamed polymeric materials used for padding in the furniture arts are well suited for this purpose, and generally such materials of a reasonably uniform dense nature with a thickness of one-half inch are sufficient.

Padding element 53 and supporting base 5,2 are covered by flexible peripheral covering 54 fastened about its edges by headed fasteners 55 extending through the covering and into the undersurface of base 52. The cover element is formed of polymeric sheet material or woven fabric such as commonly used, in the furniture upholstery arts and the technique of placement and fastening is the same as commonly used in that art. The purpose of the peripheral covering is merely to provide a flexible but yet durable surface cover for the horizontal support.

Figure 3:
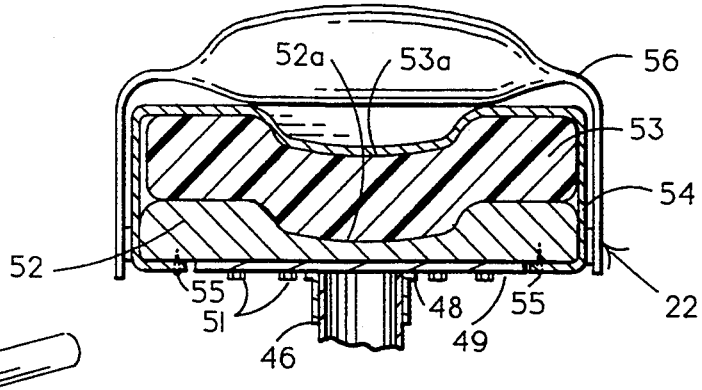
FIG. 3 is an enlarged transverse vertical cross-sectional view through the horizontal support of FIG. 1, taken on the line 3—3 thereon in the direction indicated by the arrows.

A positioning strap for use with the species of FIG. 1 is shown in FIGS. 1 and 3. The strap has similar end portions 56, each interconnectable by fasteners 57 to base 52 at the medial portion of each side of the base. The fasteners 57 in the instance illustrated comprise mating hook and pile fabric fasteners, one half of which is carried by each interconnected element. Larger knee pad 58 is carried between the strap end portions 56 so as to be positionable at the forward end of channel **53*a* to prevent a user's knee from being positioned too far forwardly on the support pad so that a forward tipping moment might be generated. The knee pad portions may be adjustably positioned, within limits, by moving strap 56 relative to fasteners 57, but its rearward portion should not be forwardly of support shaft 21**.

Figure 8:
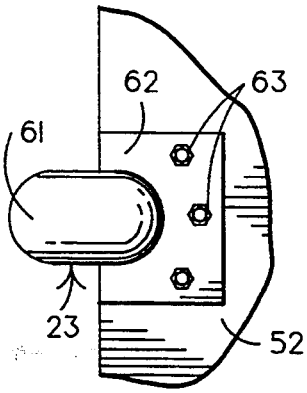
FIG. 8 is a bottom view of a portion of the horizontal support of FIG. 1 showing the interconnection of the handlebar standard therewith.
Figure 6:
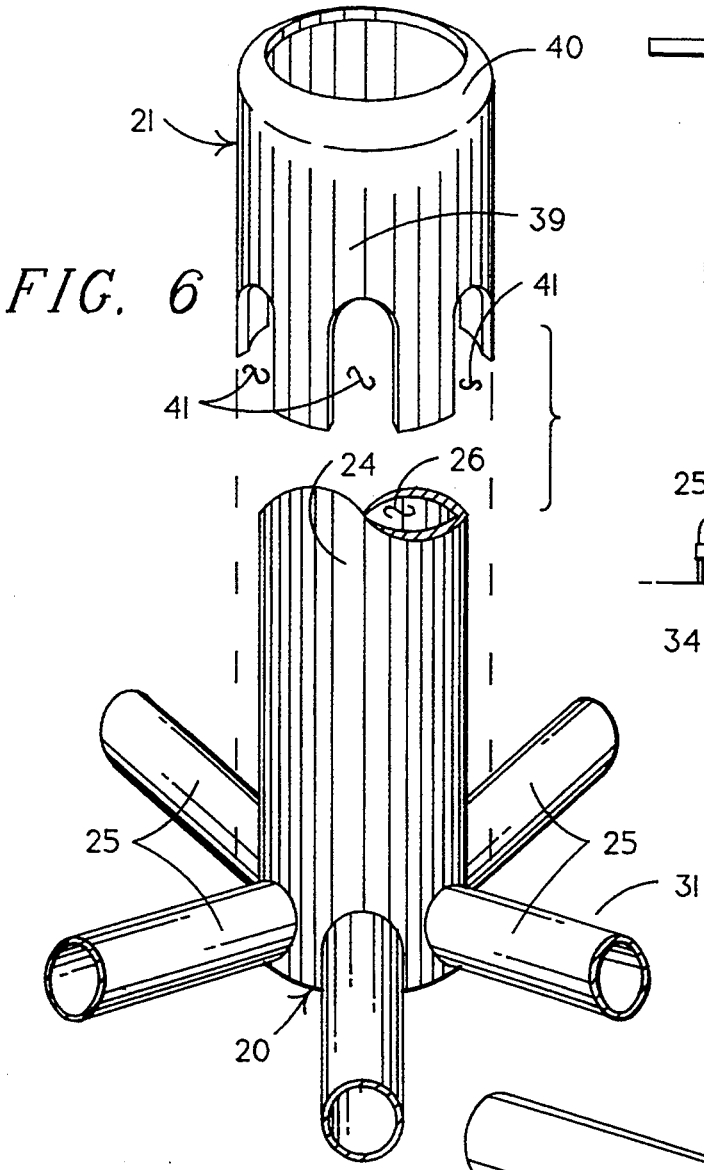
FIG. 6 is an expanded, partially cut-away and enlarged isometric view of the interconnection of the lower support shaft and legs of the wheel assembly.

Handlebar assembly 23 provides vertically oriented tubular handlebar support formed by upper body portion 59 telescopingly engaged in incrementally larger lower body portion 60. As seen in FIG. 8, lower end 61 of lower body portion 60 is bent perpendicularly to define an elbow with a flattened portion to structurally interconnect fastening plate 62 which is carried by the lower surface of rigid base 52 by means of lural fasteners 63 extending through spaced holes defined in the fastening plate and into threaded engagement with the rigid base 52. The uppermost part of upper body portion 59 structurally interconnects angulated handlebar 68 extending generally horizontally in a symmetrical fashion on both sides thereof.

Figure 5:
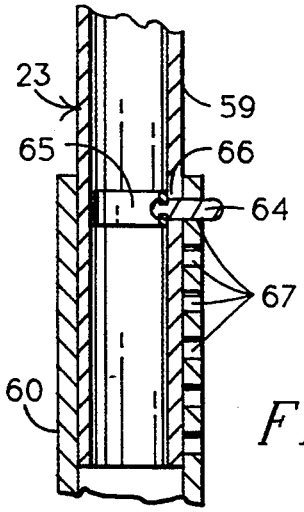
FIG. 5 is a partial vertical cross-sectional view through the adjustable interconnection of the upper and lower portions of the adjustable standard of the handlebar assembly, taken on the line 5—5 of FIG. 1 in the direction indicated by the arrows thereon.

The adjacent portions of handlebar assembly body portions 59, 60 provide cooperating adjustable fastening means to allow selective adjustment of the height of the assembly. In the instance illustrated in FIG. 5, the fastening means comprise pin 64 outwardly biased by leaf spring 65 to extend through hole 66 defined in the lower part of upper body portion 59 and through one of plural holes 67 defined in spaced lineal array in the upper part of lower body portion 60. This structure is well known for the adjustable interconnection of telescopically related tubes and provides a convenient adjustable fastening means for the handlebar support of my invention, though other similar structures that accomplish the same purpose are within the scope of my invention.

The overall vertical length of the handlebar support should be such as to position handlebar 68 at a convenient height for manual grasping by a user to aid support, motion and steerage of the device, normally between approximately forty to sixty inches above a surface supporting my orthopedic support device. The means that adjustably interconnect the body elements 59, 60 should be such as to allow vertical adjustment of approximately twelve inches to position the handlebar within a comfortable range for a majority of support users. The length of the handlebar is not critical, but normally should not be much greater overall than the width of base 52 for convenience. If desired the handlebar structure might support resiliently deformable tubular grips as seen in FIG. 13.

A second species of my invention having a pedestal for positional maintenance of my orthopedic support on a supporting surface and a fixed caster wheel to aid steerage is shown in FIGS. 9–12. In this species, base **20*b* and support shaft 21*b* differ from the first species, but the horizontal support 22 and handle bar assembly 23** remaining the same.

As seen especially in FIG. 10, the base **20*b* differs from the first species in that one caster wheel 34*a* has its shaft 35 rigidly interconnected to depending portion 31 of leg 25 by weld 69 made at the junction of the wheel shaft and the top of bushing 33 before placement of the end cap 38 on its supporting leg. With first positioning of the shaft of a caster wheel of the cylindrical type illustrated, rolling motions of the wheel will tend to direct support motion parallel to the plane of rotation of the wheel. Any one of the supporting caster wheels may be fixedly positioned in this fashion to aid directional motion, but normally either the most forwardly or most rearwardly wheel will be so positioned to direct lineal motion in a somewhat linear course substantially parallel to the longer sides of horizontal support 22 in a forward or rearward direction. In this species, the inwardly facing surfaces of the depending portions 31 of legs 25 are interconnected by annular tubular support ring 84** to provide additional strength to the structure and a potential foot support for a seated patient.

The support shaft **21*b* of this second species provides hub 70 that depends below its interconnection with legs 25 but yet is spacedly above a supporting surface on which wheels 34, 34*a* are supported. Tubular pedestal 71 defines medial channel 72 to slidably receive the lower portion of hub 70 below legs 25 and extends a distance therebelow. The lower portion of channel 72 fixedly carries depending foot cup 73 which in turn fixedly carries depending foot 74 formed of resiliently deformable, higher frictional material such as rubber or plastic. Extension spring 75 is carried in channel 72 between the lower portion of hub 70 and the upper portion of foot cap 73 to bias the tubular pedestal and associated structures downwardly to assure contact of foot 74** with an underlying supporting surface.

The external surface of hub 70 carries mounting block 76 having outwardly extending fastening pin 77. Elongate pedestal catch 78 provides lower fastening portion 79 structurally carried by tubular pedestal 71 and extends upwardly adjacent to mounting block 76 and therebeyond to define upper handle 80. As seen in FIG. 12, the upper medial portion of the pedestal catch defines medial vertically extending pin slot 81 communicating with upper and lower pin fastening notches 82 and 83 respectively. The notches 82, 83 and pedestal catch 78 are so configured that when fastening pin 77 is in upper notch 82 foot 74 is above a surface supporting my device while when the pin is in lower notch 83 the foot is in contact with that supporting surface to aid positional maintenance of the device on an underlying supporting surface.

A third species of my support device that is somewhat more compact, especially to allow maneuvering in congested areas, is illustrated in FIGS. 13–15. Here the wheel assembly **20*c* provides central hub 24*c* that is somewhat longer than that structure in the first species to allow the lower portion of the central hub to extend closer to a supporting surface. Wheel legs 25*c* have somewhat longer downturned outer portions 31*c* which support caster wheels 34*c* in a fashion similar to that of the first species. The inner end portions 85 of legs 24*c* are upturned to fit about the outer vertical surface of central hub 24*c* where they are structurally interconnected. The legs are structurally joined to each other by support ring 84 communicating therebetween at the juncture between horizontal leg portion 25*c* and the downturned portion 31*c*. Annular cap 86 extends from support tube 42 radially outwardly to cover the ends of upturned portions 85 of wheel legs 25*c***. This wheel structure of the third species is somewhat different from the first species in having less radial extent to allow greater maneuverability and greater vertical extent to better accommodate pedestal structure for positional maintenance on a supporting surface.

The support shaft structure 21 of this third species is substantially the same as that of the other two species except that fastening plate **49*c* is angulated somewhat downwardly in its medial portion to provide a somewhat stronger interconnection with support shaft 42, and the forward and rearward ends are covered by depending cover plate 87**.

As seen in FIG. 14, horizontal support **22*c* of the third species provides rigid base 52*c* carrying padding element 53*c* with cover 54*c* extending thereabout. The upper surface of base 52*c* defines knee channel 88 and the padding element fits comformly on that upper surface, but does not define any distinct and separate knee channel in its upper surface. The peripheral configuration of the horizontal support 22c is smaller than that of the first and second species, with a forward and rearward dimension of approximately nine and one-half inches and a lateral dimension of approximately seven and one-half inches. Dimensioning in this range is important to the functioning of the third species as it is necessary to maintain the horizontal support with small enough dimensions that it may be positioned on the rearward side of support tube 42** so that forces created by a user on the support will not have any overturning torque in a forward direction. With this third species of horizontal support, it is not necessary to use a knee strap and pad as in the first and second species.

The handlebar support 23c of the third species in its upper portion is the same as in the first and second species, but it differs from those first and second species in providing a different fastening element for interconnection with horizontal support 22c. In the third species, the "U" shaped portion of support tube 89 structurally supports lower portion 50c of the body element of the handlebar support. Elongate legs 90 of the support tube are so configured as to fit spacedly inwardly adjacent to each lateral side of base 52c, and they are fastened to the base in this position by screw-type fasteners 55c extending through holes in fastening plate 49c and in the legs 90 to threadedly engage the base 52c. The fasteners 55c serve a dual purpose of fastening support element 89 to horizontal support 22c and fastening the horizontal support to fastening plate 49c of the support shaft structure 21.

The lower portion of central hub 24c that depends below its interconnection with inner end portions 85 of wheel legs 25c carries tubular pedestal 71c defining medial channel to slidably receive the lower portion of support shaft 24a and extends a distance therebelow. The lower portion of the pedestal channel fixedly carries depending foot cup 73c, which in turn fixedly carries depending foot 74c of a resiliently deformable frictional nature.

The pedestal structure is moved vertically by a bell crank linkage shown particularly in FIG. 15. The bell crank having outer arm 91 and inner arm 92 has the medial portion of its inner arm pivotally mounted on bolt-type axle 93 carried by the hub 70 spacedly above legs 25c. The end of inner arm 92 of the bell crank lever pivotally interconnects with elongate pedestal leg 93. The lower portion of the pedestal leg is bent perpendicularly inwardly toward the adjacent pedestal 71 and is pivotally carried in pedestal rod hole 94 defined in that pedestal. The configuration of these various elements that move the pedestal is such as to create an over-center linkage shown in dashed outline in FIG. 15 so that when the outer end portion of outer leg 91 of the pedestal crank arm is moved upwardly, the pedestal tube 71 is moved downwardly to bring foot 74 into supportative contact with an underlying surface. This position is maintained by the over-center linkage until such time as that linkage is moved to its relaxed position shown in solid outline in that Figure.

Having thusly described the structure of my invention, its use may be understood.

A first species of support is constructed and assembled according to the foregoing specification and adjusted to comfortably accommodate a particular user. The horizontal support 22 is adjusted in vertical position by releasing adjustment screw 29 from engagement with inner wall 45 of fastening channel 44 defined in the upper support shaft 42. The upper support shaft is then moved relative to the hub 24 to bring the upper surface of horizontal support 22 to a desired level where it comfortably supports the medial portion of the lower leg of a user when bent at the knee, normally twenty to twenty-five inches above a supporting surface, and is fastened in that position.

The handle bar support 23 is also adjusted. Fastening pin 64 is moved inwardly to release its interconnection in a particular hole 67 and the upper portion 59 of the handlebar support is moved relative to lower portion 60 to position handlebar 68 at a comfortable elevation for use by the particular user. When this position is attained, the nearest hole 67 is moved over pin 64 which then is extended, by reason of the outward bias created on the pin by leaf spring 65, outwardly and through hole 67 to releasably fasten the support elements in this position. The normal height of the handlebar structure will range between about forty-four to fifty-two inches above a surface supporting the entire device, depending upon the anatomy and comfort preferences of a user.

Strap ends 56, if used, are positioned so that when a user's leg to be supported is resting in medial indentation 53a of the horizontal support, the leg is rearwardly of the vertical extension of the support shaft 21. With a leg in this position, the center of gravity of the supported body portion is rearwardly of the support point of the horizontal support to prevent forward overturning of the support during motion.

The support in this condition is ready for use to support the knee portion of the bent lower leg of a user. In this regard it should be noted that since the support is essentially symmetrical about a forward-rearward medial line, it may be used to support either the right or left leg of a user and its operation in so doing is substantially the same for either leg.

To move the support, the weight of a user is first placed on the injured leg which is being supported, and the other leg is moved in a walking motion to a new position in the direction in which locomotion is to be accomplished. The user's weight is then transferred to the non-supported leg and the support device moved in the desired direction, to and past the non-supported leg as far as can comfortably be accomplished.

The support may also be moved to some degree by moving the handlebar structure by use of the user's hands, arms and torso. During the moving operation, a user must maintain his balance by reason of a combination of support on the non-supported leg and on the support device itself in a fashion similar to that previously described. Since the motions involved are similar to ordinary walking motions, the support motion is quite easily learned and almost instinctive for most users.

The second species of my invention is used substantially the same as the first species. When the support is moved over a supporting surface, however, the fixedly mounted wheel 90 will direct any rolling motion of the support along a particular predetermined line that is substantially parallel to the wheel and perpendicular to its journal. When it is desired to move this second species, the pedestal catch is raised by manual manipulation of handle 80 to place fastening pin 77 in upper fastening notch 82 to maintain foot 74 above a supporting surface and allow free motion of the support device. If it be desired to positionally maintain this species, the pedestal catch is again manipulated to lower the pedestal 71 and bring foot 74 into contact with a supporting surface. The required manipulation of the pedestal catch may be easily accomplished by manual manipulation by a user of the device.

The third species of my support device operates in a fashion substantially similar to the second species. The device is adjusted for vertical height of horizontal support 22c and of handlebar 68 so that they present a comfortable support for a user. The user then places his bent knee on the horizontal support and moves the device in the same fashion as the first two species. If it be desired to lower the pedestal structure for positional maintenance on an underlying supporting surface, the outer leg 91 of the pedestal bell crank is moved upwardly from the position shown in solid outline to that shown in dotted outline in FIG. 15. This in turn moves the pedestal downwardly until foot 74c contacts the underlying supporting surface for positional maintenance, and the condition of the bell crank is maintained by reason of its over-center action. To raise the pedestal and allow motion of the device, a bell crank is manually manipulated to its first position shown in solid outline in FIG. 15. It should be noted that in using the third species of support device that a user's knee and the lower leg downwardly adjacent thereto will be supported on the horizontal support 22c in a position which will always create more force rearwardly of support tube 42 so that any overturning moment will always be in a rearward direction and never in a forward direction. This construction provides greater stability of the device for a user as he can readily counter any rearward overturning force since that force would be tending to cause motion toward the center of gravity of a user, whereas the user may not be able to compensate for a forwardly directed overturning force which might cause the user to fall from the support. It should also be noted that this third species is of a somewhat more compact nature than the first and second species which allows the third species to be better maneuvered and used in crowded areas but yet provide substantially the same support as the other species.

It should also be noted that my support device might also be used in the fashion of a chair for support of a seated user, though not so comfortably as an ordinary chair. Such use as a chair, however, does allow change of a user's support position and mode which may be desirable over lengthy periods of use.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A wheeled orthopedic support for a lower disabled leg bent at the knee, to allow user locomotion comprising in combination:

a wheeled base having a central hub defining a vertically oriented medial channel and supported by plural radially extending wheel legs having depending caster wheels with vertical mounting shafts in their outer portions with at least one caster wheel being irrotatable about its vertical mounting shaft to aid steerage and said hub having means for fastening a support shaft in vertically adjustable relationship;

a support shaft carried in the medial channel of the hub in a vertically upstanding orientation, said support shaft carrying in its upper portion a fastening plate with means to interconnect a horizontal support on the fastening plate;

an elonagate, horizontal support carried on the fastening plate of the support shaft, said horizontal support having a lower rigid base defining a medial indentation extending parallel its longer dimension to receive the knee portion of a bent leg of a user in a conformable fit, and supporting a resiliently deformable padding element thereabove with peripheral covering extending about the rigid base and padding element;

a fastening strap with an enlarged medial knee pad to limit the forward extension of a supported knee portion of a lower leg of a user, said fastening strap being releasably and adjustably attachable to the medial portion of each opposed longer side of the horizontal support to extend thereof; and handlebar assembly having a compound support extending vertically upwardly from structural support at the medial portion of a shorter forward side of the horizontal support, said support having means for adjustment of vertical extension and carrying in its upper portion an elongate handlebar.

2. A wheeled orthopedic support for a lower disabled leg bent at the knee, to allow user locomotion, comprising in combination;

a wheeled base having a central hub defining a vertically, oriented medial channel and supported by plural radially extending wheel legs having depending caster wheels with vertical mounting shafts in their outer portions with at least one caster wheel being irrotatable about its vertical mounting shaft to aid steerage and said hub extending spacedly below the wheel legs and slidably carrying a depending pedestal structure for vertical motion from a first position spacedly above a surface supporting the support to a second position communicating with the supporting surface to positionally maintain the support on the supporting surface, said pedestal structure having an elongate pedestal catch with a lower fastening portion carried by the pedestal and an upper portion extending spacedly above the pedestal, said pedestal catch defining a vertically elongate pin slot having two vertically spaced fastening notches, and a fastening pin carried by a mounting block supported on the surface of the hub adjacent the medial pin slot to operatively communicate through the pin slot and selectively with either fastening notch;

a support shaft carried in the medial channel of the hub in a vertically upstanding orientation, said support shaft carrying in its upper portion a fastening plate with means to interconnect a horizontal support on the fastening plate;

an elongate, horizontals support carried on the fastening plate of the support shaft, said horizontal support having a lower rigid base defining a medial indentation extending parallel its longer dimension to receive the knee portion of a bent leg of a user in a conformable fit, and supporting a resiliently deformable padding element thereabove with peripheral covering extending about the rigid base and padding element; and handlebar assembly having a compound support extending vertically upwardly from structural support at the medial portion of a shorter forward side of the horizontal support, said support having means for adjustment of vertical extension and carrying its upper portion an elongate handlebar.

3. A wheeled orthopedic support for a lower disabled leg bent at the knee, to allow user locomotion, comprising in combination:

a wheeled base having a central hub defining a vertically oriented medial channel and supported by plural radially extending wheel legs having depending caster wheels with vertical mounting shafts in their outer portions with at least one caster wheel being irrotatable about its vertical mounting shaft to aid steerage and said hub extending spacedly below the wheel legs and slidably carrying a depending pedestal structure for vertical motion from a first position spacedly above a surface supporting the support to a second position communicating with the supporting surface to positionally maintain the support on the supporting surface, said pedestal structure having a pedestal bell crank with an outer leg an angulated inner leg carried by a fastener pivot supported by the hub spacedly above the pedestal and a pedestal rod pivotally carried by the end of the inner leg of the pedestal bell crank distal from the outer leg, said pedestal rod extending to pivotal interconnection with the pedestal for over-center motion;

a support shaft carried in the medial channel of the hub in a vertically upstanding orientation, said support shaft carrying in its upper portion a fastening plate with means to interconnect a horizontal support on the fastening plate;

an elongate, horizontal support carried on the fastening plate of the support shaft, said horizontal support having a lower rigid base defining a medial indentation extending parallel its longer dimension to receive the knee portion of a bent leg of a user in a conformable fit, and supporting a resiliently deformable padding element thereabove with peripheral covering extending about the rigid base and padding element; and handlebar assembly having a compound support extending vertically upwardly from structural support at the medial portion of a shorter forward side of the horizontal support, said support having means for adjustment of vertical extension and carrying in its upper portion an elongate handlebar.

4. A wheeled orthopedic support for a disabled lower leg bent at the knee, to allow user locomotion, comprising in combination:

a wheeled base having a vertically orientated central hub defining a medial channel, said hub supported by and extending below plural, radially extending wheel legs each carrying a caster wheel having a vertical support shaft for rotatable support, with at least one caster wheel being irrotatably carried for rotation about its vertical support shaft to aid steerage in the place of that wheel, and having means for fastening a support shaft slidably carried in the medial channel in vertically adjustable relationship, and a depending pedestal slidably carried about the lower portion of the hub to depend therebelow, said pedestal having a pedestal bell crank with an outer leg and an angulated inner leg carried by a fastener pivot supported by the hub spacedly above the pedestals and a pedestal rod pivotally carried by the end of inner leg of the pedestal bell crank distal from the outer leg, said pedestal rod extending to pivotal interconnection with the pedestal for over-center motion to selectively move the pedestal between a first position spacedly above a surface supporting the pedestal to a second position wherein the pedestal communicating with the supporting surface to positionally maintain the support thereon;

a support shaft carried in the medial channel of the hub, said support shaft carrying in its upper portion a horizontal fastening plate with means to interconnect a horizontal support on the upper portion of the fastening plate;

an elongate horizontal support carried on the upper portion of the fastening plate, said horizontal support having a lower rigid base supporting a resiliently deformable padding element thereabove with peripheral covering extending about both the base and the padding elements, said base defining a medial indentation to receive the bent knee portion of a leg of a user in a conformable fit; and a handlebar assembly having a compound telescopically related upstanding support body extending vertically upwardly from structural support on the horizontal support, said support body having means for adjustment of vertical extension and carrying in its upper portion an elongate handlebar extending therefrom.

* * * * *